US005971474A

United States Patent [19]

Chang

[11] Patent Number: 5,971,474

[45] Date of Patent: Oct. 26, 1999

[54] COLLAPSIBLE GLIDER CHAIR

[75] Inventor: Tony Wei-Sin Chang, San Jose, Calif.

[73] Assignee: Variety Electronic Inc., Santa Clara, Calif.

[21] Appl. No.: 09/149,416

[22] Filed: Sep. 8, 1998

[51] Int. Cl.[6] ..... A47C 4/00

[52] U.S. Cl. ..... 297/56; 297/41; 297/452.13; 297/452.2

[58] Field of Search ..... 297/16.1, 463.1, 297/463.2, 31, 41, 55, 56, 59, 452.2, 452.13

[56] References Cited

U.S. PATENT DOCUMENTS

| | | | |
|---|---|---|---|
| 611,144 | 9/1898 | Plummer | 297/31 X |
| 2,573,915 | 11/1951 | Lewis | 297/31 X |
| 2,697,476 | 12/1954 | Tripodi et al. | 297/41 X |
| 2,713,890 | 7/1955 | Mack | 297/31 |
| 5,507,548 | 4/1996 | Marhefka | 297/59 X |

*Primary Examiner*—Milton Nelson, Jr.

[57] ABSTRACT

A collapsible glider chair having stopping devices for stopping the motion of chair frames and stabilizing the chair. The glider chair comprises a seat-base frame, a back-support frame, a pair of armrests and a pair of link members pivotally connected. A pair of stopping devices are affixed onto the seat-base frame or link members to stop the movement of chair frames while one is standing up and pushing down the armrests. The stopping devices may be affixed near the armrests or the link members for blocking either the armrests or the link members. Anti-slippery devices are also mounted on both the seat-base frame and the back-support frame to increase the contact friction to a floor or ground and stabilize the chair.

15 Claims, 4 Drawing Sheets

COLLAPSIBLE GLIDER CHAIR

FIELD OF THE INVENTION

The present invention relates to a glider chair, and more specifically to a collapsible glider chair.

BACKGROUND OF THE INVENTION

Collapsible chairs have been very popular because they are space saving and easy to carry around for both indoor or outdoor use. The demand in comfortable glider chairs for outdoor camping and relaxing has attracted many patio furniture manufacturers to manufacture various glider chairs that are also collapsible.

There are many important factors to consider when manufacturing a collapsible glider chair. The structure of such a chair has to be light weight and strong. It should take as little space as possible if collapsed. In addition, safety in using the chair maybe one of the most important thing. Various support or stopping structures are often added to the chair to prevent it from being tipped over or collapsed accidentally.

FIG. 1 shows an exploded view of a conventional collapsible glider chair that is designed to have both simple structure and light weight. The collapsible glider chair comprises a seat-base frame 101, a back-support frame 102, a pair of link members 103, and a pair of armrests 104. The seat-base frame includes a seat bar 105 for supporting legs. The back-support frame also includes a head bar 106 for supporting the head of a person.

The head bar 106 and the seat bar are connected by an elongated piece of fabric 107 or other material to form a seat base as well as a back-support. To make it more comfortable, a pillow may be added at the head end of the fabric to cover the head bar 106. Both armrests 104 and link members 103 have one end connected to the seat-base frame 101 and the other end connected to the back-support frame 102. Pivot pins are used for jointing the armrests and link members to seat-base frames and back-support frames so that each joint is pivotally connected.

As shown in FIG. 1, the seat-base frame, back-support frame, link members and armrests are connected in such a way that they form a stable chair for a person when the chair is fully opened in an upright position. An additional link bar 108 may also be added to support weight and stabilize the chair when a person is standing up from the chair. For easy storage, the glider chair can be collapsed illustrated in FIG. 2.

As discussed above, it is important that a collapsible glider chair is safe. Because many parts of a collapsible chair are pivotally connected for easy folding, the chair may be tipped over if the weight of a person is not properly distributed. The additional link bar 108 as shown is an example of an additional safety feature for the chair. Nevertheless, the additional link bar also adds cost in manufacturing the chair as well as the space required for storage.

There is a strong need in providing safety features for a collapsible glider chair. The safety feature should add as little cost as possible in manufacturing the chair. The additional weight and shipping space of the safety feature should also be as small as possible.

SUMMARY OF THE INVENTION

The present invention has been made to satisfy the above mentioned need in the structure and design of a collapsible glider chair. The primary object of this invention is to provide an improved structure of a collapsible glider chair which is both safer and more stable. A second object is to provide an improved collapsible glider chair structure that can be easily manufactured with little additional cost. It is also an object to provide a safe collapsible glider chair which can be shipped or stored with less space.

The collapsible chair of the present invention has a seat-base frame, a back-support frame, a pair of link members and two armrests similar to those of the conventional collapsible glider chair. According to this invention, cylindrical devices are affixed to the seat-base frame or the link member as a stopping device to stabilize the glider chair. One end of the cylindrical device comprises a concave surface having a curvature substantially identical to the surface curvature of the member of the seat-base frame for easy attachment.

In using a collapsible glider chair, one usually pushes down the armrests as a support in order to stand up. The cylindrical device is positioned near either the connecting point between the seat-base frame and the armrest or the link member so that the motion of the chair can be stopped to hold the weight of a person stably. In addition, anti-slippery devices are also added to the seat-base frame or the back-support frame to stop the slipping of the chair while it is gliding or swinging. Therefore, it prevents the chair and the person from falling off or being tipped over.

DETAILED DESCRIPTION OF THE PREFERRED EMBODIMENTS

Figure 3:
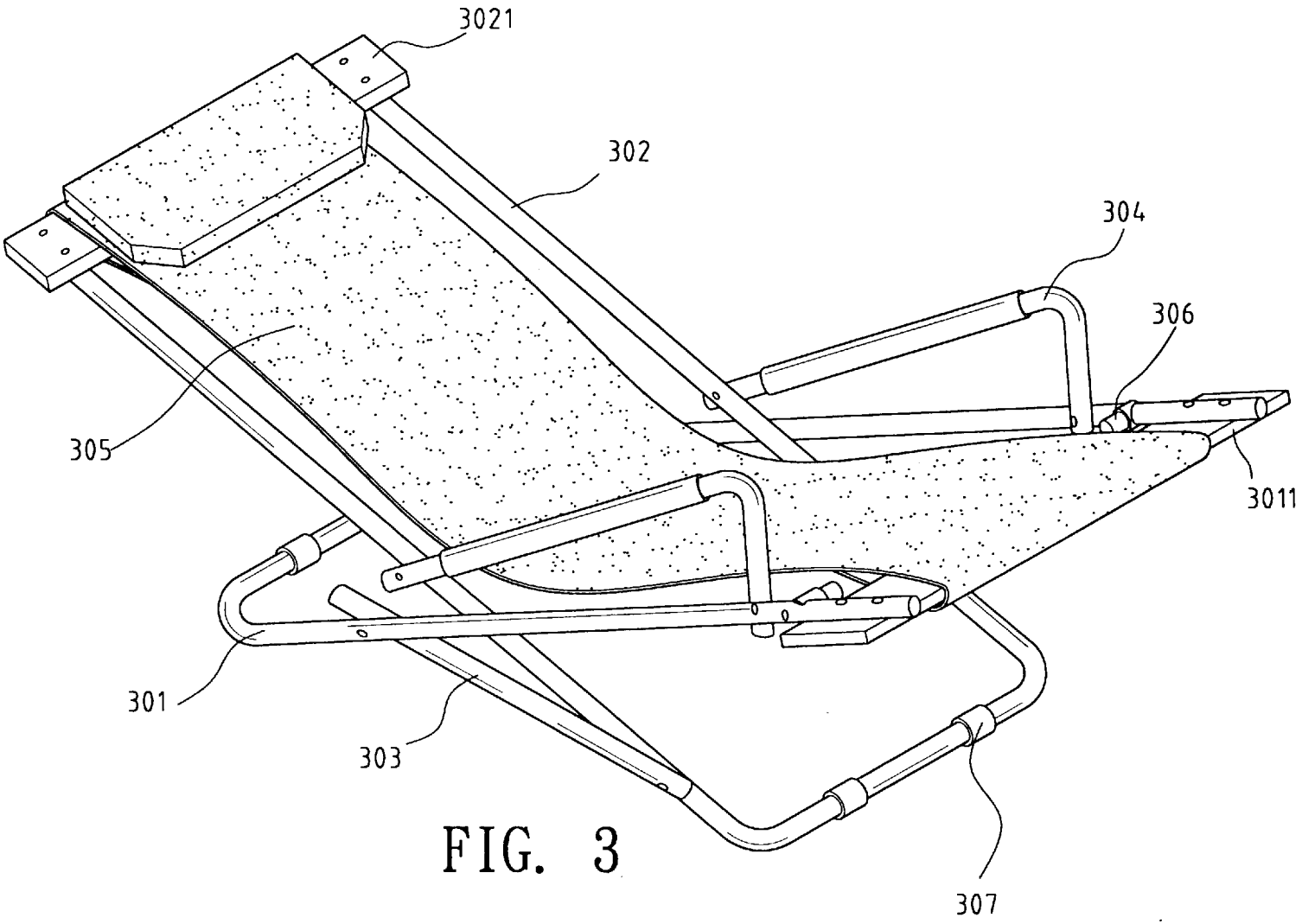
FIG. 3 shows an exploded view of the collapsible glider chair of this invention.

With reference to FIG. 3, the collapsible glider chair of the present invention comprises a seat-base frame 301, a back-support frame 302, a pair of link members 303, a pair of armrests 304 and a pair of anti-slippery devices 307. The back-support frame 302 is made of a U-shaped metal tube. A wood bar 3021 connects the open end of the U-shaped metal tube and forms the back-support frame.

The seat-base frame 301 comprises a U-shaped metal tube whose open end is connected by a wood bar 3011. Each link member 303 has one end pivotally connected to the seat-base frame and the other end pivotally connected to the back-support frame as shown in FIG. 3. Each armrest 304 is an L-shaped metal tube that is also pivotally connected to both the seat-base frame and the back-support frame.

Figure 1:
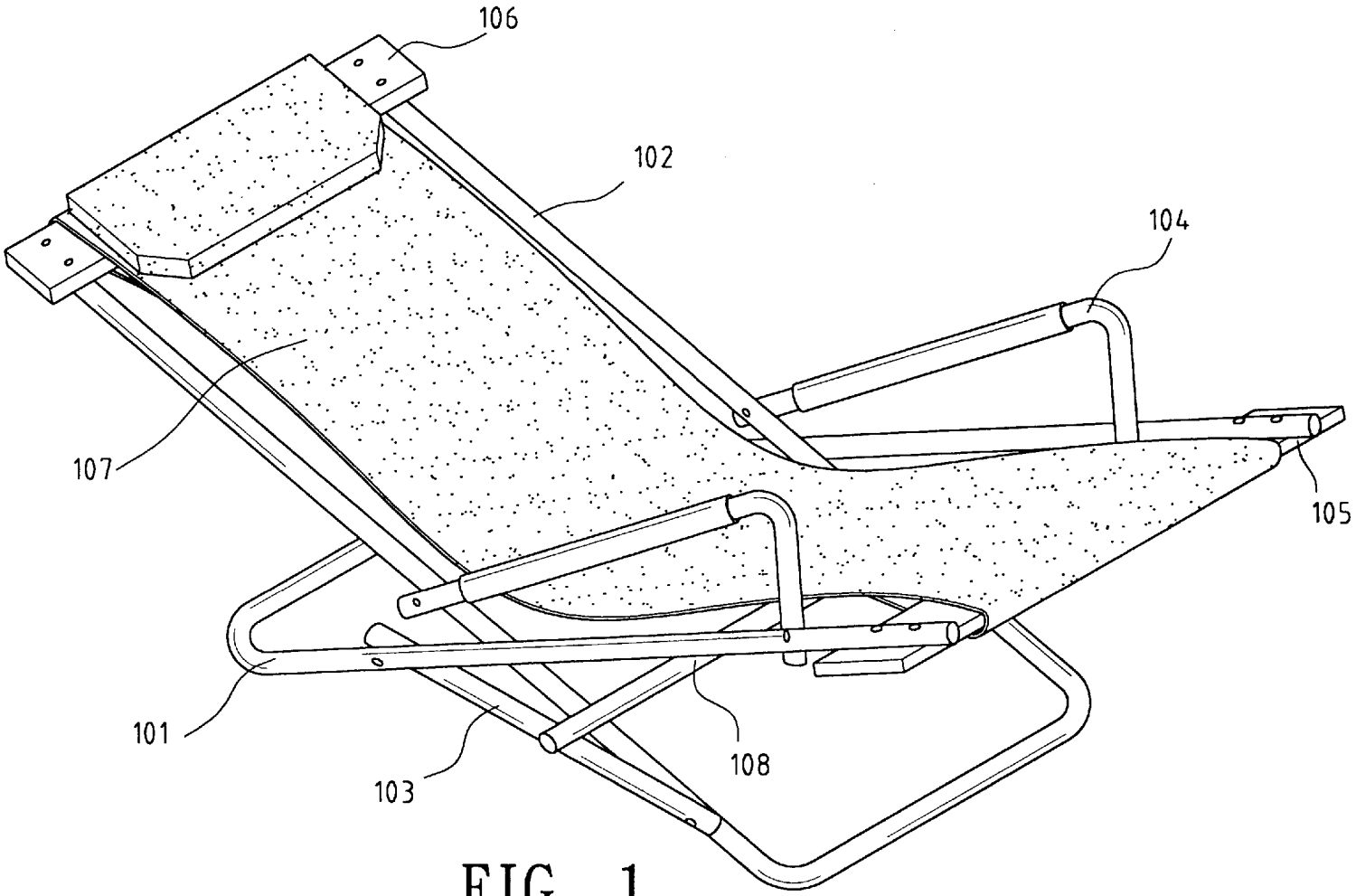
FIG. 1 (PRIOR ART)
FIG. 1 shows an exploded view of a conventional collapsible glider chair.
Figure 2:
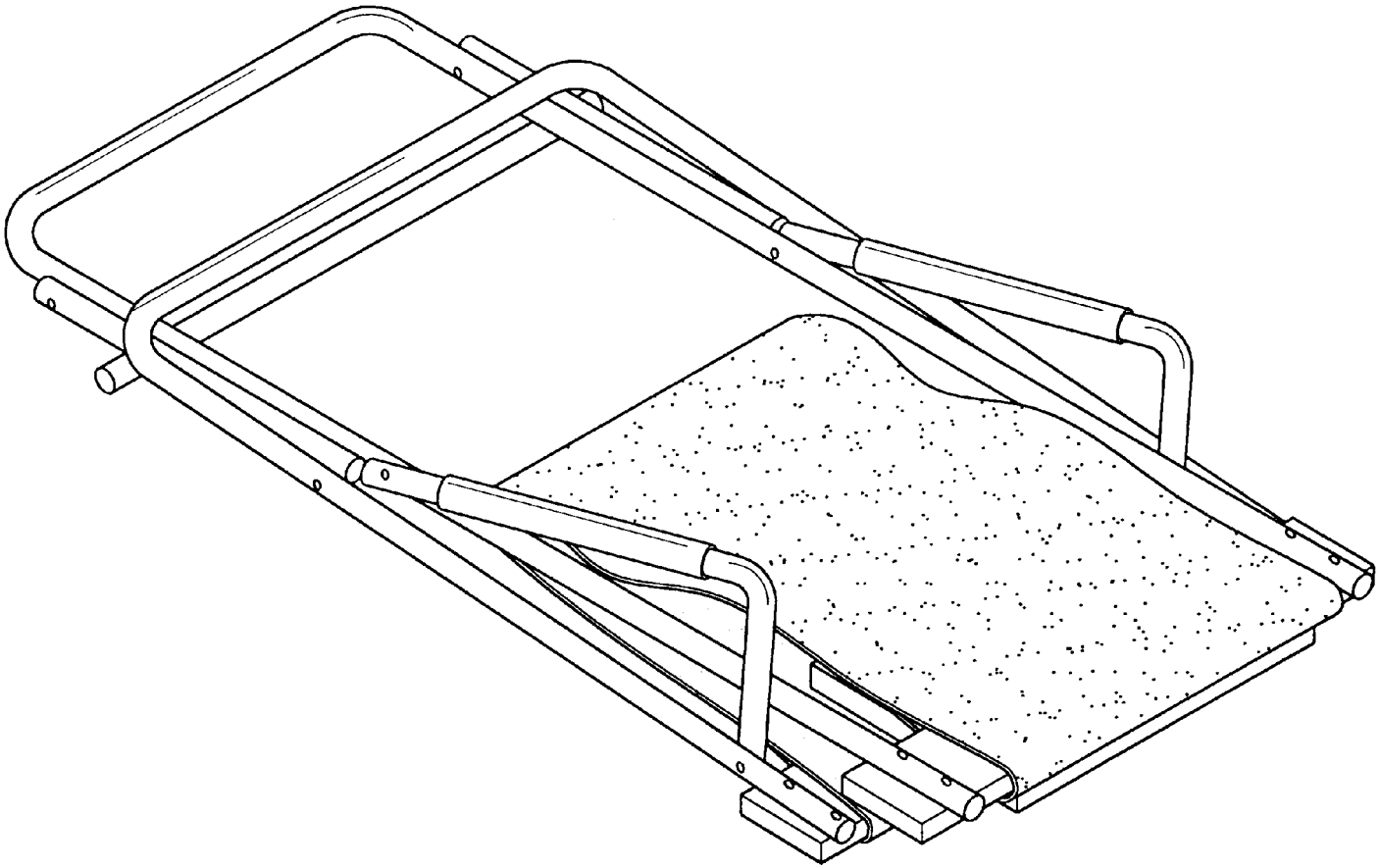
FIG. 2 (PRIOR ART)
FIG. 2 shows a perspective view of the conventional collapsible glider chair when it is collapsed for storage.

The width of the seat-base frame 301 is slightly larger than that of the back-support frame 302. Pivot pins are used to connect the link members and armrests to the seat-base frame and back-support frame so that the two frames can rotate with respect to the pivot pins in a limited range. When the two frames are opened up, the link members 303 and armrests 304 hold the frames to form a glider chair in an upright position. The two frames can also be collapsed for storage in a form similar to that shown in FIG. 2.

A chair cloth 305 connecting the seat-base frame and the back-support frame forms a seat or cot for the glider chair. The two ends of the chair cloth are connected to the respective wood bars of the seat-base frame and back-support frame. The chair cloth is usually extended at the end of the wood bar 3021 of the back-support frame for enclosing a pillow cushion to support the head of a person. The chair cloth is a piece of elongated cloth, vinyl, canvas or any other strong synthetic fabric.

Stopping devices 306 are affixed to the seat-base frame 301. The preferred embodiment of the stopping device is a cylindrical device. One end of the cylindrical device 306 may have a slightly larger diameter and a concave bottom surface with two protruded edges. The bottom concave surface is shaped to have a similar curvature as the surface curvature of the tube forming the seat-base frame 301. Therefore, the cylindrical device 306 can be securely affixed to the seat-base frame 301 near the end of the armrest 304 as shown in FIG. 3 to stop the relative movement between the armrest 304 and the seat-base frame 301.

Figure 4:
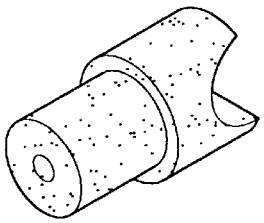
FIG. 4 shows a magnified view of the cylindrical device for stopping the movement of the seat-base frame of the collapsible glider chair of this invention.

To affix the cylindrical device, a through hole is formed on the tube of the seat-base frame. The cylindrical device 306 is screwed onto the seat-base frame 301 by using a screw which passes through the hole and drills into the cylindrical device 306. A hole slightly smaller than the screw may be pre-formed in the center of the cylindrical device to guide the screw. FIG. 4 shows a magnified view of the preferred cylindrical device of this invention.

By having such a stopping device 306, the relative movements between the armrests 304 and the seat-base frame 301 are limited. Therefore, the back-support frame 302 that is connected to the armrests 304 and linked to the seat-base frame 301 also has limited movement relative to the seat-base frame 301. When a person is standing up from the glider chair, the chair is balanced to support the person and reduce the danger of being tipped over.

In order to further stabilize the chair, a plurality of anti-slippery devices 307 are added to both the seat-base frame 301 and the back-support frame 302 as shown in FIG. 3. The anti-slippery device 307 can prevent the chair from moving forward or backward while a person is standing up. The device, which is made of a plastic material, has a shape of a ring. The bottom surface of the device can be made flat with grooves on it so that better contact and increased friction with the floor or ground can be achieved.

Figure 5:
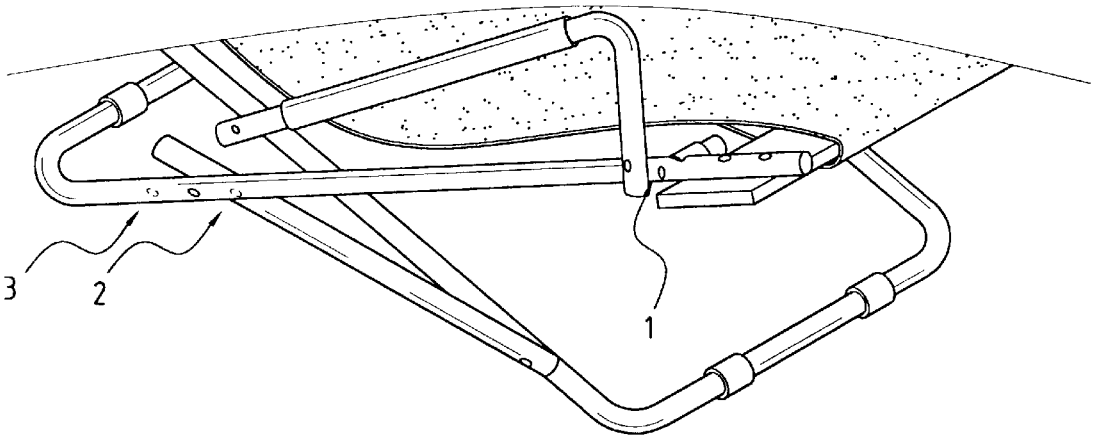
FIG. 5 shows that the cylindrical device may be affixed in different locations on the seat-base frame.

As discussed above, the function of the stopping device 306 is to stop the relative movements between parts of the glider chair to increase the safety. The stopping device may also be affixed else where on the seat-base frame 301 or the link member 303. FIG. 5 illustrates three different locations 1, 2 and 3 where the stopping device may be mounted. If the device is mounted near the link member 303, it will stop the relative movement by blocking the link member 303. For both positions 1 and 3, the way to mount the stopping device is similar. However, it should be noted that the device is facing a direction when mounted in position 2 on the link member 303.

In the preferred embodiment of this invention, the seat-base and back-support frames, the link members and the armrests can all be made of metal tubes. For the purpose of easy shipping and carrying, it is preferred that light metal tubes such as aluminum alloy tubes be used. Foam material may be used to cover the armrests for adding more comfort. The cylindrical device can be made either by metal or plastic material. For easy manufacturing and lower cost, plastic material is preferred.

While the present invention has been described with reference to a preferred embodiment, those skilled in the art will recognize that various modifications may be made. Variations upon and modifications to the preferred embodiment are provided by the present invention, which is limited only by the following claims.

What is claimed is:

1. A collapsible glider chair comprising:

a seat-base frame having a tubular cross-section;

a back-support frame;

a pair of armrests each having a first end pivotally connected to said seat-base frame, and a second end pivotally connected to said back-support frame;

a pair of link members each having a first end pivotally connected to said seat-base frame and a second end pivotally connected to said back-support frame; and a pair of stopping devices affixed to said seat-base frame near the location where said armrests and said seat-base frame are connected for limiting the relative pivotal movement between said armrests and said seat-base frame, each of said stopping devices being a cylindrical device having a concave end with two slightly protruded edges, said concave end having a concave curvature substantially matching the curvature of the tubular cross-section of said seat-base frame;

wherein said cylindrical device is securely screwed onto said seat-base frame by a fastening device.

2. The collapsible glider chair according to claim 1, wherein said seat-base frame and said back-support frame further comprise at least one anti-slippery device mounted thereon for stabilizing said chair and increasing contact friction between said chair and a floor or ground.

3. The collapsible glider chair according to claim 1, wherein said seat-base frame, said back-support frame, said link members and said armrests are made of an alloy, and said stopping devices are made of an alloy.

4. The collapsible glider chair according to claim 1, wherein said seat-base frame, said back-support frame, said link members and said armrests are made of an alloy, and said stopping devices are made of a plastic material.

5. The collapsible glider chair according to claim 1, wherein said cylindrical device has a first section comprising a main cylindrical body and a second section comprising said concave end, said first section having a diameter slightly smaller than the diameter of said second section.

6. A collapsible glider chair comprising:

a seat-base frame having a tubular cross-section;

a back-support frame;

a pair of armrests each having a first end pivotally connected to said seat-base frame and a second end pivotally connected to said back-support frame;

a pair of link members each having a first end pivotally connected to said seat-base frame and a second end pivotally connected to said back-support frame; and a pair of stopping devices affixed to said seat-base frame near the location where said link members and said seat-base frame are connected for limiting the relative pivotal movement between said link members and said seat-base frame, each of said stopping devices being a cylindrical device having a concave end with two slightly protruded edges, said concave end having a concave curvature substantially matching the curvature of the tubular cross-section of said seat-base frame;

wherein said cylindrical device is securely screwed onto said seat-base frame by a fastening device.

7. The collapsible glider chair according to claim 6, wherein said seat-base frame, said back-support frame, said link members and said armrests are made of an alloy, and said stopping devices are made of a plastic material.

8. The collapsible glider chair according to claim 6, wherein said seat-base frame and said back-support frame further comprise at least one anti-slippery device mounted thereon for stabilizing said chair and increasing contact friction between said chair and a floor or ground.

9. The collapsible glider chair according to claim 6, wherein said seat-base frame, said back-support frame, said link members and said armrests are made of an alloy, and said stopping devices are made of an alloy.

10. The collapsible glider chair according to claim 6, wherein said cylindrical device has a first section comprising a main cylindrical body and a second section comprising said concave end, said first section having a diameter slightly smaller than the diameter of said second section.

11. A collapsible glider chair comprising:

a seat-base frame;

a back-support frame;

a pair of armrests each having a first end pivotally connected to said seat-base frame and a second end pivotally connected to said back-support frame;

a pair of link members each having a first end pivotally connected to said seat-base frame and a second end pivotally connected to said back-support frame each of said link members having a tubular cross-section; and a pair of stopping devices affixed to said link members near the location where said link members and said seat-base frame are connected for limiting the relative pivotal movement between said link members and said seat-base frame, each of said stopping devices being a cylindrical device having a concave end with two slightly protruded edges, said concave end having a concave curvature substantially matching the curvature of the tubular cross-section of a link member;

wherein said cylindrical device is securely screwed onto a link member by a fastening device.

12. The collapsible glider chair according to claim 11, wherein said cylindrical device has a first section comprising a main cylindrical body and a second section comprising said concave end, said first section having a diameter slightly smaller than the diameter of said second section.

13. The collapsible glider chair according to claim 11, wherein said seat-base frame, said back-support frame, said link members and said armrests are made of an alloy, and said stopping devices are made of a plastic material.

14. The collapsible glider chair according to claim 11, wherein said seat-base frame and said back-support frame further comprise at least one anti-slippery device mounted thereon for stabilizing said chair and increasing contact friction between said chair and a floor or ground.

15. The collapsible glider chair according to claim 11, wherein said seat-base frame, said back-support frame, said link members and said armrests are made of an alloy, and said stopping devices are made of an alloy.

* * * * *